US011186351B2

(12) United States Patent
Miyashita

(10) Patent No.: US 11,186,351 B2
(45) Date of Patent: Nov. 30, 2021

(54) OUTBOARD-MOTOR MOUNTING DEVICE

(71) Applicant: SUZUKI MOTOR CORPORATION, Hamamatsu (JP)

(72) Inventor: Yasushi Miyashita, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 0 days.

(21) Appl. No.: 16/903,941

(22) Filed: Jun. 17, 2020

(65) Prior Publication Data

US 2020/0398963 A1 Dec. 24, 2020

(30) Foreign Application Priority Data

Jun. 20, 2019 (JP) ..... JP2019-114501

(51) Int. Cl.
*B63H 20/06* (2006.01)
*B63H 20/12* (2006.01)
*B63H 20/10* (2006.01)

(52) U.S. Cl.
CPC ..... *B63H 20/06* (2013.01); *B63H 20/106* (2013.01); *B63H 20/12* (2013.01)

(58) Field of Classification Search
CPC ..... B63H 20/06; B63H 20/12; B63H 20/106
See application file for complete search history.

(56) References Cited

U.S. PATENT DOCUMENTS 4,391,592 A * 7/1983 Hundertmark ..... B63H 20/10 440/61 R
5,032,094 A * 7/1991 Katogi ..... B63H 20/10 440/61 R
9,004,962 B1 * 4/2015 Pelini ..... B63H 20/10 440/61 D

FOREIGN PATENT DOCUMENTS

JP H0544797 U 6/1993

* cited by examiner

*Primary Examiner* — Stephen P Avila
(74) *Attorney, Agent, or Firm* — Holtz, Holtz & Volek PC

(57) ABSTRACT

An outboard-motor mounting device is provided with: a clamp bracket (20) to be attached to a stern portion (15) of a hull; a swivel bracket (60) disposed between the clamp bracket and an outboard motor body (1); a trim-tilt equipment (40) that swings the outboard motor body back and forth via the swivel bracket; and a lift equipment (30) that lifts or lowers the outboard motor body via the swivel bracket. The lift equipment having a lift cylinder (33) for lifting is liftably supported on the clamp bracket, and the trim-tilt equipment having a tilt cylinder (44) and a trim cylinder (47) is disposed behind the lift equipment so that the tilt cylinder is positioned behind the lift cylinder and the trim cylinder is positioned on the side of the tilt cylinder.

7 Claims, 10 Drawing Sheets

OUTBOARD-MOTOR MOUNTING DEVICE

BACKGROUND OF THE INVENTION

Field of the Invention

The present invention relates to a mounting device for mounting an outboard motor onto a hull.

Description of the Related Art

In an outboard motor mounted on a stern of a hull, a position of a propeller with respect to the water surface (propeller depth) greatly influences navigation performance. For example, when the position of the propeller is excessively deep, the drive efficiency of the propeller decreases due to an increase in underwater resistance. When the position of the propeller is excessively shallow, a part of the propeller comes out of the water surface to cause loss of propulsion. Hence at the time of mounting the outboard motor onto the hull, the height position of the outboard motor is adjusted to be appropriate. The draft changes in accordance with the load capacity of the hull for luggage and people, and it is thus difficult to always keep the propeller depth optimal only by setting a fixed height position of the outboard motor.

There are outboard motors capable of performing a tilt operation and a trim operation to swing in the front-rear direction. However, in the tilt operation and the trim operation, the orientation of the rotating shaft of the propeller changes along with a change in propeller depth, thereby limiting the adjustment of the propeller depth.

There are a wide variety of specifications for ships, and the shape of the stern varies. There is thus a case where, at the time of causing the outboard motor to perform the tilt operation or the trim operation, a gap between the outboard motor and the ship bottom cannot be ensured. This leads to a desire for an outboard-motor mounting device less affected by the shape of the stern.

When the ship is moored while the outboard motor is mounted on the hull, it is required to ensure a sufficient gap between the water surface and the lower end of the outboard motor. When a sufficient gap is not ensured, there is a possibility that seaweed, wisteria, or the like adheres and the resistance to the outboard motor increases during navigation, causing deterioration in performance.

Upon the demand and requirement as described above, there is known an outboard-motor mounting device equipped with a lift function apart from the tilt operation and the trim operation, the lift function making the outboard motor linearly liftable with respect to the hull (e.g., Japanese Utility Model Laid-Open No. 5-44797).

The conventional outboard-motor mounting device with lift equipment has had problems of a size increase caused by the provision of the lift equipment and the ensuring of the strength and durability. For example, in an outboard-motor mounting device in Japanese Utility Model Laid-Open No. 5-44797, a support bracket is supported by a structure where a slide rod is inserted through two, upper and lower, fixing brackets and a tubular guide. Further, a sliding guide is also provided outside the tubular guide to form a double cylinder structure. This structure is complex and has difficulties in ensuring the rigidity because the fixing brackets are separated vertically. This is a structure where a slide portion for lift (slide rod, etc.) is exposed to the side surface portion of the mounting device, and thus easily catches foreign matter such as dust on the water surface. Also, this is a structure where the exposed area of metal (stainless steel material, etc.) used in the slide rod and the like is large, and it is disadvantageous against electrolytic corrosion. Further, depending on the positional relationship among the slide rod, a lift cylinder, a tilt cylinder, a trim cylinder, and the like, it has occurred that the dimensions and weight of the entire mounting device increase, or the position of the outboard motor with respect to the hull is greatly shifted backward.

Moreover, the mounting device of Japanese Utility Model Laid-Open No. 5-44797 has a structure where a supporting mechanism such as the slide rod is attached to the hull side and thus has a problem that its size tends to increase compared to a mounting device of a type where a supporting mechanism is provided in the outboard motor. Furthermore, the mounting device needs to be attached separately from the outboard motor, whereby man hours for mounting tend to increase to cause an increase in cost.

In addition, some of the mounting devices with lift equipment except for the mounting device of Japanese Utility Model Laid-Open No. 5-44797 are using a complex link mechanism for the lift equipment and are not suitable for lifting or lowering the outboard motor that is a heavy object.

SUMMARY OF THE INVENTION

In view of the aforementioned problems, the illustrated embodiment of the invention provides an outboard-motor mounting device with lift equipment, the mounting device being compact and excellent in strength and durability.

According to an embodiment of the invention, an outboard-motor mounting device is provided with: a clamp bracket to be attached to a stern portion of a hull; a swivel bracket disposed between the clamp bracket and an outboard motor body; a trim-tilt equipment that swings the outboard motor body back and forth via the swivel bracket; and a lift equipment that lifts or lowers the outboard motor body via the swivel bracket. The lift equipment having a lift cylinder for lifting is liftably supported on the clamp bracket, and the trim-tilt equipment having a tilt cylinder and a trim cylinder is disposed behind the lift equipment so that the tilt cylinder is positioned behind the lift cylinder and a trim cylinder is positioned on a side of the tilt cylinder.

According to the present invention, it is possible to obtain an outboard-motor mounting device with lift equipment, the device having favorable space efficiency in component arrangement and being compact and excellent in strength and durability.

The present disclosure relates to subject matter contained in Japanese Patent Application No. 2019-114501 (filed on Jun. 20, 2019) which is expressly incorporated herein by reference in its entirety.

DETAILED DESCRIPTION OF THE PREFERRED EMBODIMENT

Figure 1:
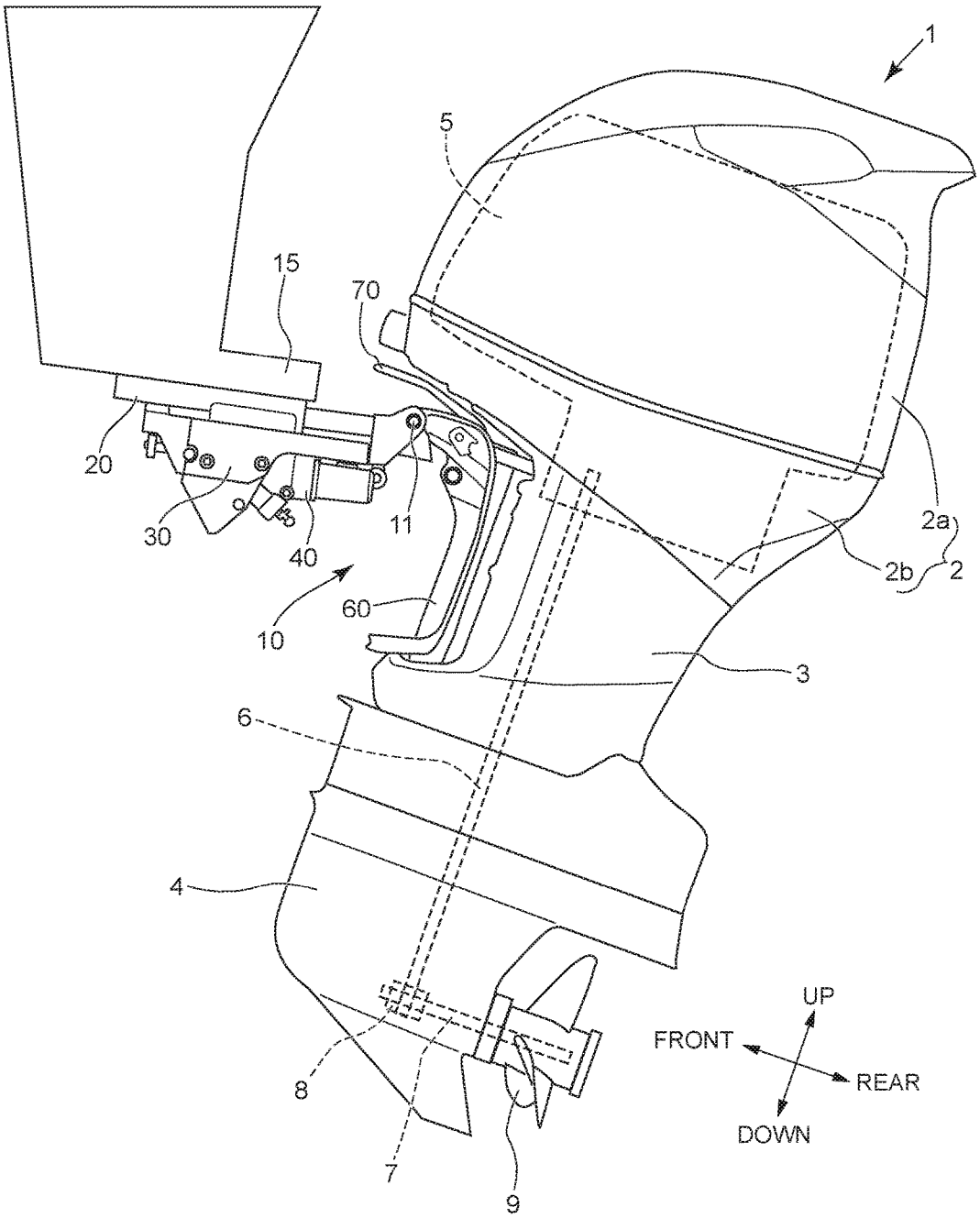
FIG. 1 is a side view of an outboard motor body and an outboard-motor mounting device according to the present embodiment.

An embodiment of the present invention will be described below with reference to the accompanying drawings. FIG. 1 is a side view of an outboard motor according to the present embodiment. The outboard motor is made up of an outboard motor body 1 and a mounting device 10. In the following description and each drawing, a direction in which a drive shaft 6 (FIG. 1) to be described later extends is defined as the vertical direction of the outboard motor, and a direction in which a propeller shaft 7 (FIG. 1) extends is defined as the front-rear direction of the outboard motor. In the front-rear direction, the front is the hull side, and the rear is the outboard motor side. Further, a direction perpendicular to the vertical and front-rear directions is defined as the width direction of the outboard motor. In the width direction, the right-hand side of the hull side is right, and the left-hand side thereof is left. The outboard motor body 1 is mounted onto the stern portion of the hull by use of a mounting device 10, and the orientation of the outboard motor body 1 with respect to the hull can be changed via the mounting device 10. Therefore, each of the vertical, front-rear, and width directions in the outboard motor may not match each of the vertical, front-rear, and width directions of the hull.

As illustrated in FIG. 1, as exterior members, the outboard motor body 1 has an engine cover 2 at the top, has a drive housing 3 below the engine cover 2, and has a lower housing 4 below the drive housing 3. The engine cover 2 is made up of an upper cover 2*a* in the upper portion and a lower cover 2*b* in the lower portion.

An engine 5 is stored in an engine room inside the engine cover 2. A crankshaft (not illustrated) which is the output shaft of the engine 5 extends in the vertical direction, and a drive shaft 6 connected to the crankshaft extends to the inside of the lower housing 4 through the inside of the drive housing 3. Inside the lower housing 4, a propeller shaft 7 extending in the front-rear direction is supported rotatably. A bevel gear mechanism 8 for converting the rotational operation of the drive shaft 6 to the rotational operation of the propeller shaft 7 is provided in a portion where the drive shaft 6 and the propeller shaft 7 intersects. A propeller 9 is provided at the rear end of the propeller shaft 7. When the engine 5 is driven and the crankshaft rotates, the drive shaft 6 rotates integrally with the crankshaft, and the rotation of the drive shaft 6 is transmitted to the propeller shaft 7 via the bevel gear mechanism 8. The propeller 9 then rotates, and the propulsion by the outboard motor is generated.

The outboard motor body 1 is attached to the stern portion of the hull via the mounting device 10. In a state where the outboard motor body 1 is mounted on the hull by use of the mounting device 10, the following operations can be performed: a tilt (or trim) operation for swinging the outboard motor body 1 back and forth around a tilt shaft 11 extending in the width direction; a steering operation for swinging the outboard motor body 1 from side to side around a steering shaft 12 extending in the vertical direction (see FIG. 3); and a lift operation for linearly lifting or lowering the outboard motor body 1 along a lift shaft 32.

The mounting device 10 is provided with a clamp bracket 20, lift equipment 30, trim-tilt equipment 40, a swivel bracket 60, and a steering bracket 70. Hereinafter, the mounting device 10 will be described in detail. Note that the vertical direction in the description of the mounting device 10 means the vertical direction in the initial state illustrated in FIGS. 2 and 3. That is, although the angles of portions, except for the clamp bracket 20, of the mounting device 10 change with respect to the hull as the tilt operation or the trim operation to be described later are performed, each portion of the mounting device 10 will be described taking as a reference a state where the drive shaft 6 is directed in the perpendicular (vertical) direction without the angle change as described above.

Figure 5:
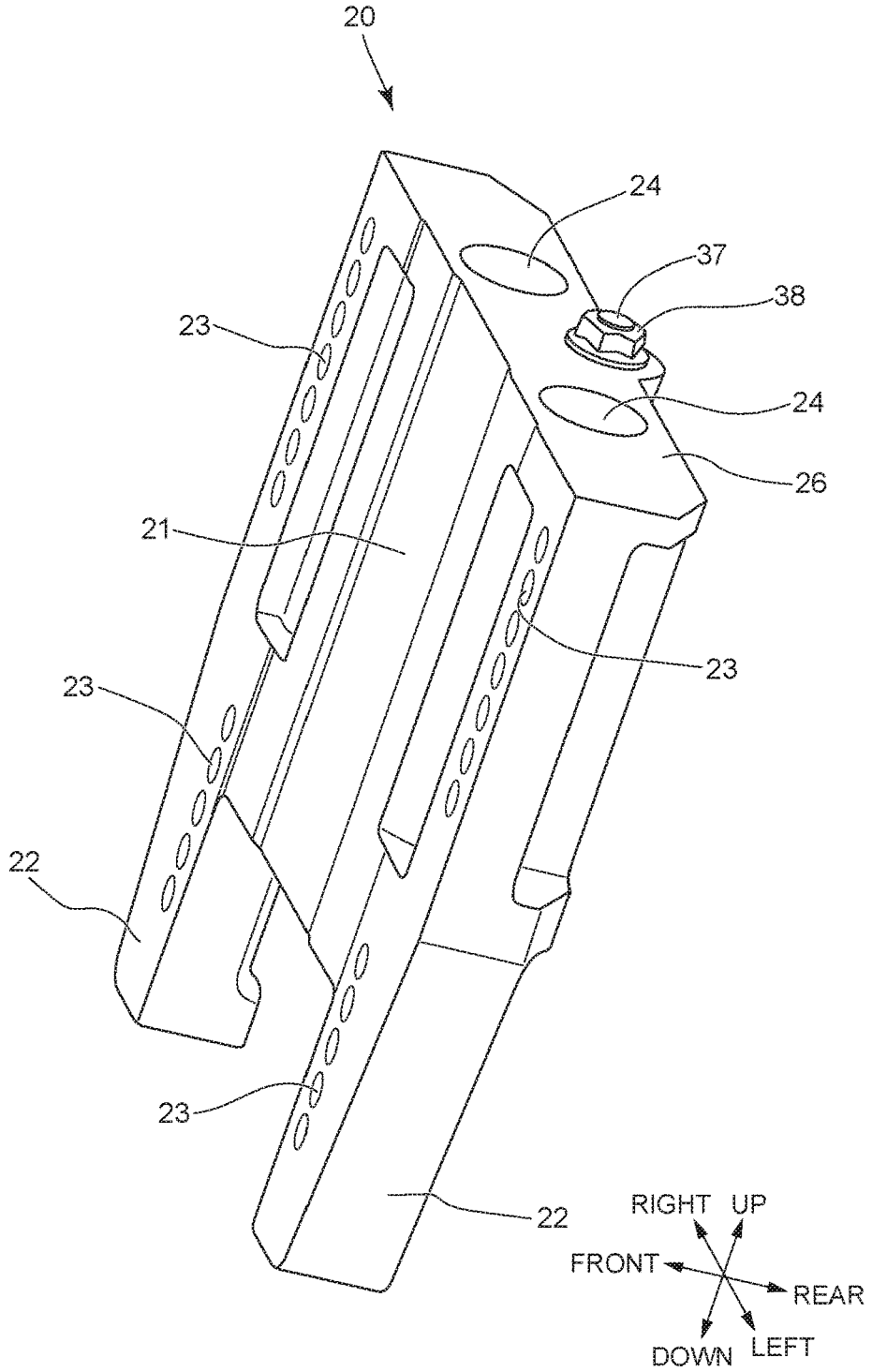
FIG. 5 is a perspective view of a clamp bracket.

A clamp bracket 20 is fixed to a transom 15 (FIG. 1) provided at the stern of the hull. As illustrated in FIG. 5, the clamp bracket 20 has a body portion 21, and a pair of legs 22 projecting downward from the body portion 21. The pair of legs 22 is located at both ends in the width direction of the body portion 21, and the lower surface of the body portion 21 and the pair of legs 22 form a U-shaped space opened downward. In the body portion 21 and the legs 22, a plurality of bolt holes 23 are formed therethrough in the front-rear direction at positions varied in the vertical direction. At the time of fixing the clamp bracket 20 to the transom 15, a bolt (not illustrated) inserted through the bolt hole 23 is screwed into a screw hole (not illustrated) on the transom 15 side. The height position of the clamp bracket 20 with respect to the transom 15 can be adjusted by changing the bolt hole 23 on the clamp bracket 20 side to be associated with the screw hole on the transom 15 side.

In the body portion 21 of the clamp bracket 20, a pair of shaft insertion holes 24 is formed therethrough in the vertical direction. The pair of shaft insertion holes 24 is disposed at positions varied in the width direction and extending parallel to each other. Each shaft insertion hole 24 has a cylindrical inner peripheral surface with a fixed inner diameter size. In the body portion 21, a cylinder holder 25 which is a recess opened rearward (see FIGS. 4 and 9) is formed between the pair of shaft insertion holes 24. The body portion 21 has an upper wall 26 covering the upper side of the cylinder holder 25 (see FIGS. 3 and 9).

Figure 6:
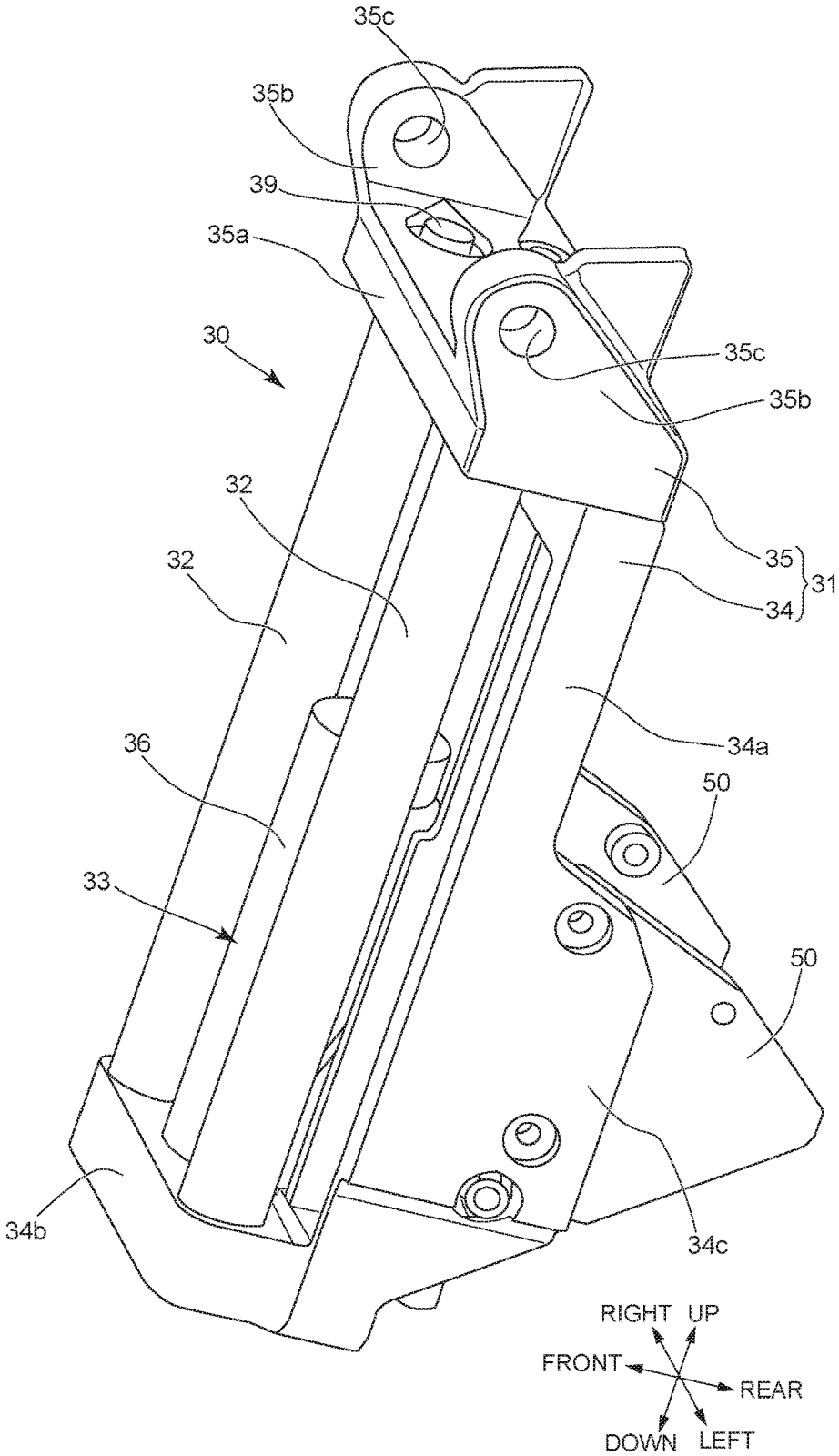
FIG. 6 is a perspective view of lift equipment.

The lift equipment 30 is assembled to the clamp bracket 20. As illustrated in FIG. 6, the lift equipment 30 is provided with a lift bracket 31, a pair of lift shafts 32, and a lift cylinder 33. The lift bracket 31 is configured in a combination of a lower bracket portion 34 and an upper bracket portion 35 and is located behind the clamp bracket 20. Each lift shaft 32 has a cylindrical outer peripheral surface with a constant external size.

Figure 4:
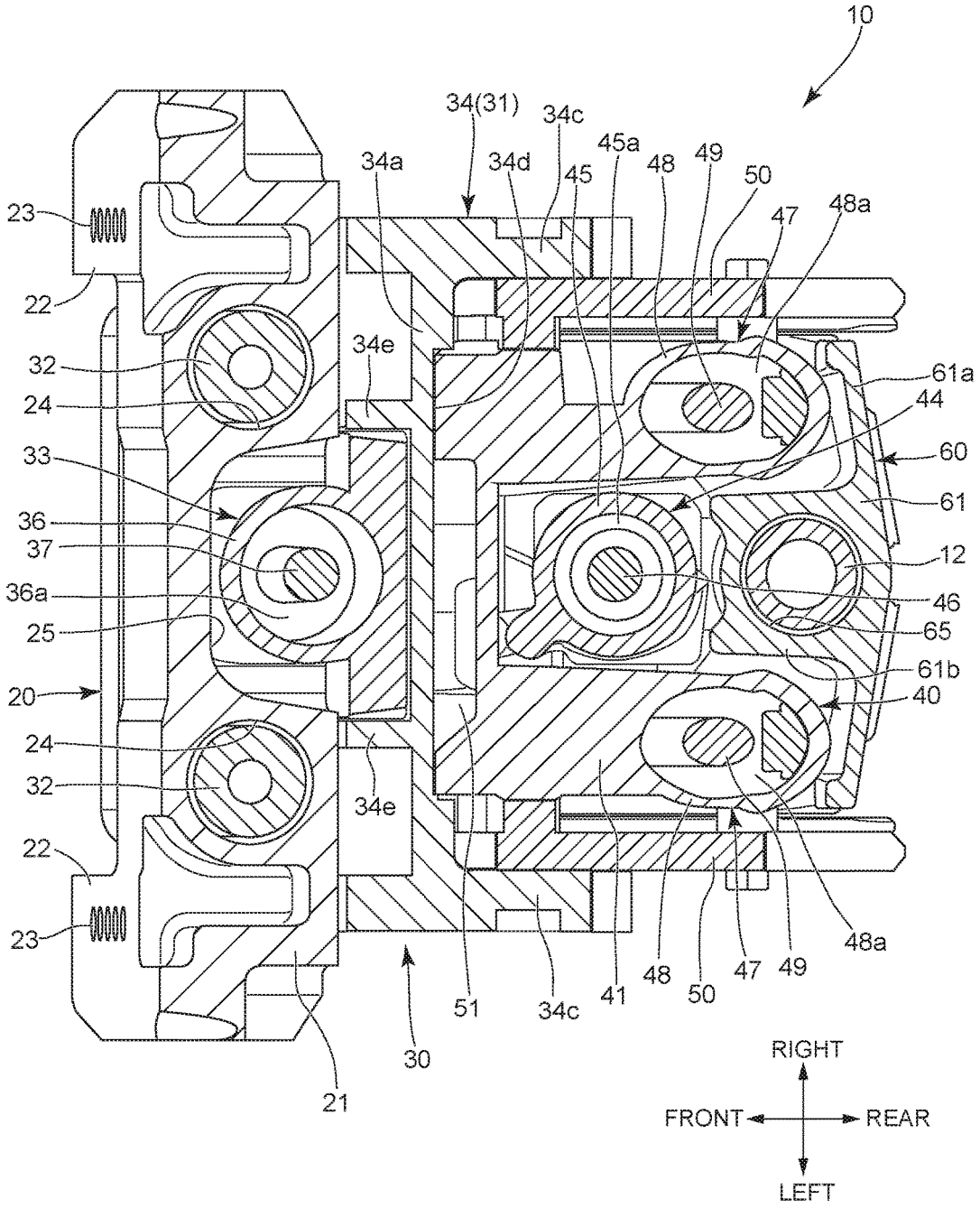
FIG. 4 is a sectional view along line IV-IV of FIG. 3.

The lower bracket portion 34 has a base portion 34*a* extending in the vertical direction, a lower-end block 34*b* projecting forward from the lower end of the base portion 34*a*, and a pair of side flanges 34*c* projecting rearward from both edges in the width direction of the base portion 34*a*. As illustrated in FIG. 4, a rear holder 34*d*, surrounded by the base portion 34*a* and the pair of side flanges 34*c*, is formed on the rear surface side of the lower bracket portion 34. The rear holder 34*d* has a U-shape opened rearward. A pair of cylinder support ribs 34*e* (see FIGS. 4 and 9) extending upward from a portion in contact with the lower-end block 34*b* is formed on the front surface side of the base portion 34*a*.

The upper bracket portion 35 has an upper-end block 35*a* fixed to the upper end of the base portion 34*a*, and a pair of rising walls 35*b* projecting upward from both edges in the width direction of the upper-end block 35*a*. In the pair of rising walls 35*b*, a pair of axial support holes 35*c* is formed coaxially therethrough in the width direction.

The pair of lift shafts 32 is disposed on the front side of the base portion 34*a* and extends in parallel. The lower end of each lift shaft 32 is fixed to the lower-end block 34*b*, and the upper end of each lift shaft 32 is fixed to the upper-end block 35*a*. The pair of lift shafts 32 is disposed with a space in the width direction, and the pair of lift shafts 32 is inserted through the pair of shaft insertion holes 24 of the clamp bracket 20. The lift equipment 30 is liftably supported on the clamp bracket 20 by the pair of lift shafts 32 receiving guidance by the respectively corresponding shaft insertion holes 24. The lower-end block 34*b* of the lift bracket 31 is located between the pair of legs 22 of the clamp bracket 20 (see FIG. 9), and as the lift equipment 30 is lifted or lowered, the position of the lower-end block 34*b* changes vertically between the pair of legs 22.

At the time of assembling the lift equipment 30 to the clamp bracket 20, the pair of lift shafts 32 in the state of being attached to the lower-end block 34*b* of the lower bracket portion 34 is inserted through the pair of shaft insertion holes 24. Subsequently, the upper bracket portion 35 is attached to fix the upper end of the pair of lift shafts 32 to the upper-end block 35*a*. Each lift shaft 32 is fixed to the upper-end block 35*a* with a bolt 39 illustrated in FIG. 6. Further, the upper-end block 35*a* is fixed to the upper end of the base portion 34*a* with a bolt (not illustrated). The lift bracket 31 is configured using two members of the lower bracket portion 34 and the upper bracket portion 35, whereby each lift shaft 32, which finally has a double supported structure where the upper and lower ends are fixed to the lift bracket 31, can be easily inserted into the shaft insertion hole 24 to facilitate assembly work.

Figure 3:
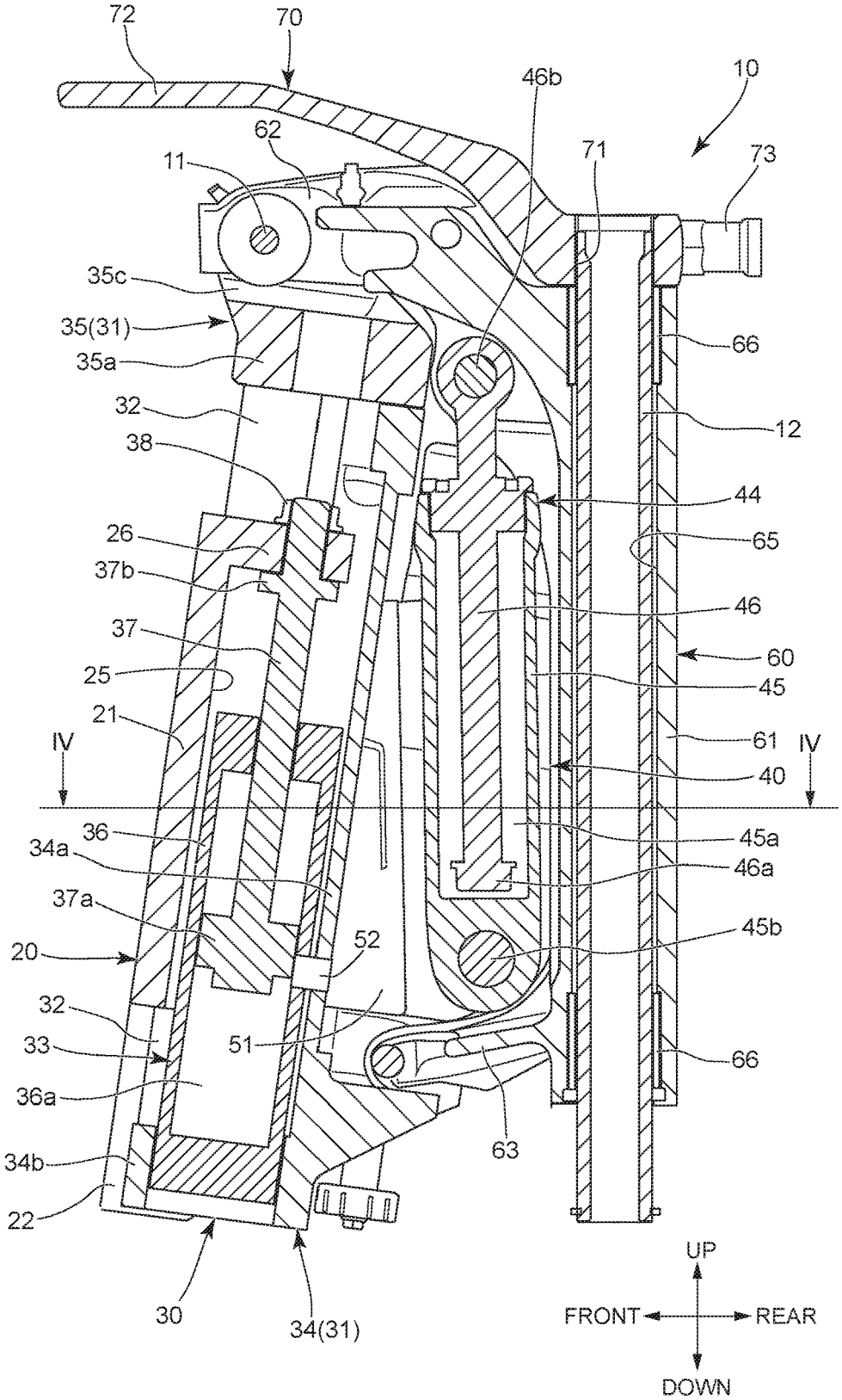
FIG. 3 is a longitudinal sectional view of the outboard-motor mounting device.

In the lift equipment 30, the lift cylinder 33 for lift drive is disposed between the pair of lift shafts 32 in the width direction. The lift cylinder 33 has a cylindrical cylinder body 36 and a piston rod 37 supported so as to be able to move linearly with respect to the cylinder body 36. As illustrated in FIG. 3, the lower end of the cylinder body 36 is fixed by being inserted into a hole formed in the lower-end block 34*b*. A portion of the cylinder body 36 close to the lower end is supported so as to be held between the pair of cylinder support ribs 34*e* provided in the lower bracket portion 34 (see FIGS. 4 and 9). When the lift equipment 30 is assembled to the clamp bracket 20, the lift cylinder 33 enters the cylinder holder 25 (see FIGS. 4 and 9).

The lift cylinder 33 is a single rod cylinder for linearly moving the piston rod 37, projecting upward from the cylinder body 36, by hydraulic pressure. The piston rod 37 penetrates an opening formed at the upper end of the cylinder body 36. Near the lower end of the piston rod 37, a piston 37*a*, located in an oil inflow space 36*a* inside the cylinder body 36 (FIG. 3), is provided. Near the upper end of the piston rod 37, an upper flange 37*b*, abutting on the upper wall 26 of the clamp bracket 20 from below, is provided. The upper end of the piston rod 37 projects above the upper wall 26, and a nut 38 is screwed to a male screw formed in the projecting portion in the piston rod 37. By tightening the nut 38, the upper wall 26 is held between the nut 38 and the upper flange 37*b*, and the piston rod 37 is fixed to the clamp bracket 20.

The lift cylinder 33 can cause the piston rod 37 to perform a reciprocating operation by hydraulic supply of oil (hydraulic oil) to the oil inflow space 36*a* of the cylinder body 36. The hydraulic supply to the lift cylinder 33 will be described later.

Figure 9:
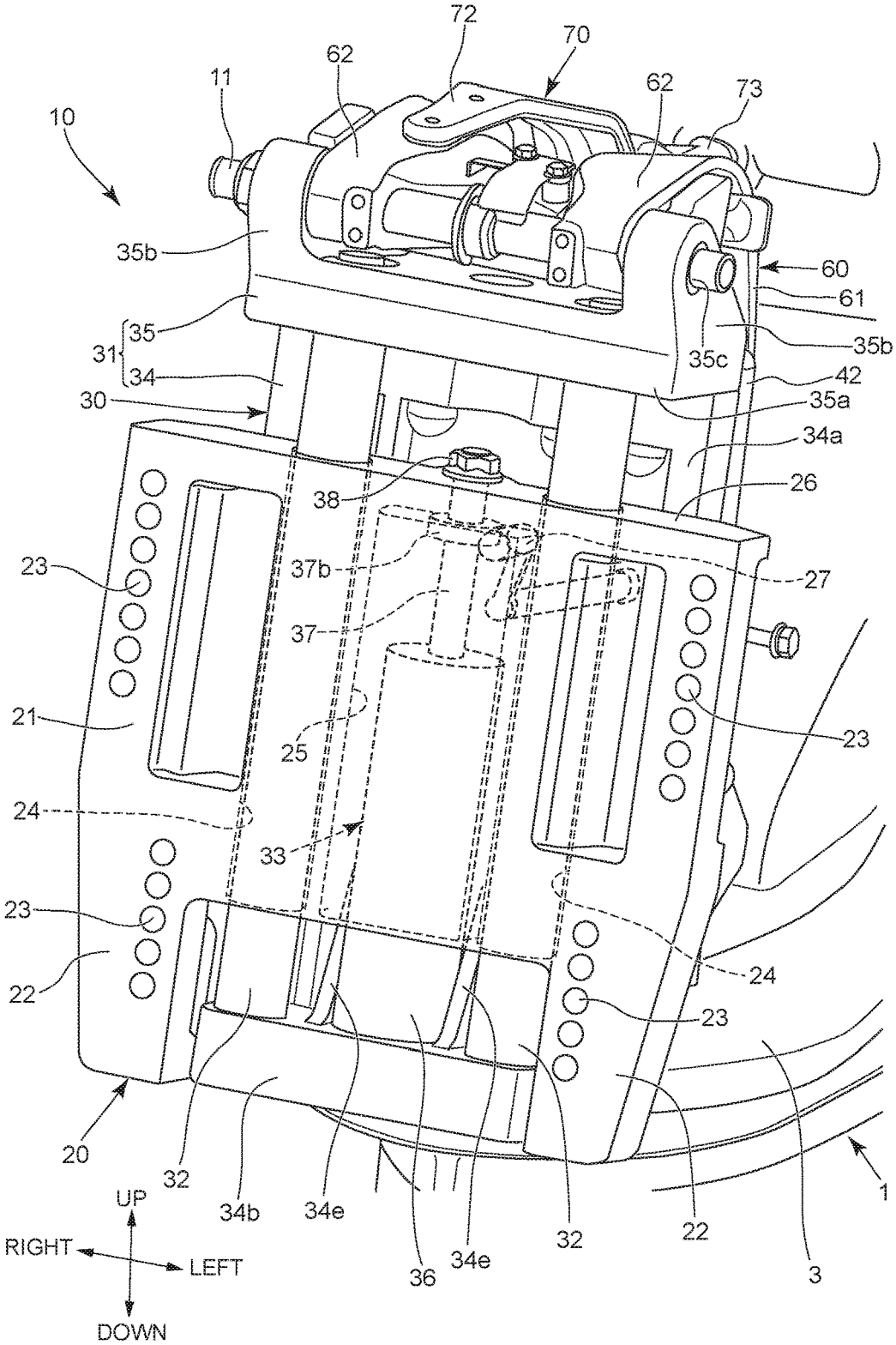
FIG. 9 is a perspective view of the outboard-motor mounting device as seen from the hull side.

As illustrated in FIG. 9, a lift sensor 27 is provided between the clamp bracket 20 and the lift bracket 31. The lift sensor 27 detects the lifting position of the lift equipment 30 with respect to the clamp bracket 20.

Figure 7:
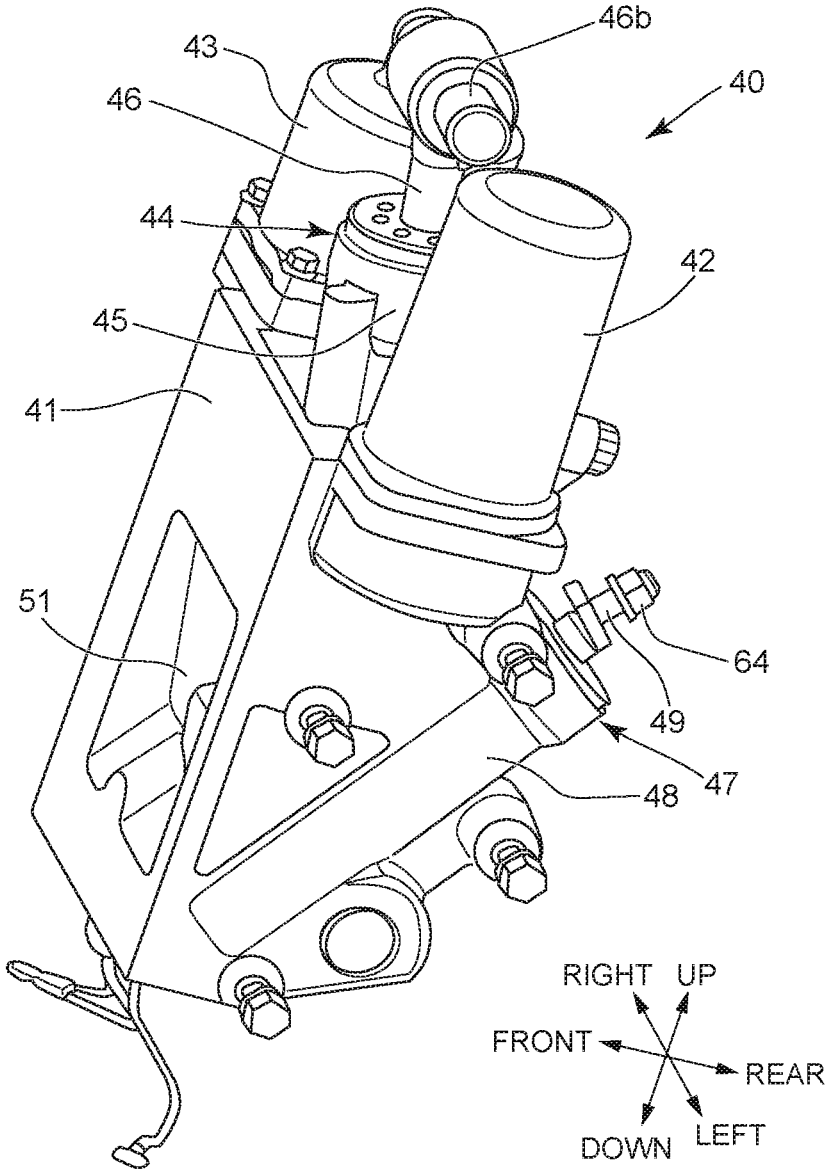
FIG. 7 is a perspective view of trim-tilt equipment.

The trim-tilt equipment 40 is assembled to the rear of the lift equipment 30. As illustrated in FIG. 7, the trim-tilt equipment 40 is provided with an electric motor 42 and a pump unit 43 at the top of a casing 41. The trim-tilt equipment 40 is provided with a hydraulic supply system including a pump unit 43, and the pump unit 43 is operated by the drive of the electric motor 42 to pump out the oil. The electric motor 42 and the pump unit 43 are provided near the left and right ends of the casing 41.

In the trim-tilt equipment 40, a tilt cylinder 44 for tilt operation is disposed between the electric motor 42 and the pump unit 43 in the width direction. As illustrated in FIG. 3, the tilt cylinder 44 has a cylindrical cylinder body 45 and a piston rod 46 supported so as to be able to move linearly with respect to the cylinder body 45.

The tilt cylinder 44 is a single rod cylinder for linearly moving the piston rod 46, projecting upward from the cylinder body 45, by hydraulic pressure. The piston rod 46 penetrates an opening formed at the upper end of the cylinder body 45. Near the lower end of the piston rod 46, a piston 46*a*, located in an oil inflow space 45*a* inside the cylinder body 45 (FIG. 3), is provided. Near the upper end of the piston rod 46, a columnar tilt cylinder pin 46*b* extending in the width direction is provided. The hydraulic supply of the oil to the oil inflow space 45*a* of the cylinder body 45 enables the reciprocating operation of the piston rod 46. The cylinder body 45 is supported so as to be swingable back and forth with respect to the casing 41 by a support shaft 45*b* (FIG. 3) extending in the width direction.

On the right and left sides of the tilt cylinder 44, a pair of trim cylinders 47 for trim operation is provided. Each trim cylinder 47 has a cylindrical cylinder body 48 formed in the casing 41, and a piston rod 49 supported so as to be able to move linearly with respect to the cylinder body 48. The piston rod 49 has a larger angle of inclination rearward than the piston rod 46 of the tilt cylinder 44, and the tip of the piston rod 49 is directed obliquely upward.

The trim cylinder 47 is a single rod cylinder for linearly moving the piston rod 49, projecting obliquely upward from the cylinder body 48, by hydraulic pressure. The piston rod 49 penetrates an opening formed at the upper end of the cylinder body 48. The hydraulic supply of the oil to the oil inflow space 48*a* of the cylinder body 48 (FIG. 4) enables the reciprocating operation of the piston rod 49.

The trim-tilt equipment 40 has a pair of side plates 50 to be fixed to the right and left of the casing 41. As illustrated in FIG. 4, the pair of side plates 50 is held between the pair of side flanges 34*c* in the lift equipment 30 and fixed to the lift bracket 31. By the pair of side plates 50 being held between a pair of side flanges 34*c*, the movement in the width direction of the trim-tilt equipment 40 with respect to the lift bracket 31 is restricted. That is, the pair of side plates 50 is fitted to the rear holder 34*d* of the lift bracket 31 and functions as a regulated portion subject to movement regulation in the width direction. In this fixed state, a part of the trim-tilt equipment 40 is fitted to the rear holder 34*d* of the lift bracket 31, and the front surface of the casing 41 is in contact with the rear surface of the base portion 34*a* of the lift bracket 31. Note that FIG. 6 illustrates a state where only the side plate 50 of the trim-tilt equipment 40 has been attached to the lift equipment 30 side.

The lift cylinder 33 of the lift equipment 30 and the tilt cylinder 44 and the trim cylinder 47 of the trim-tilt equipment 40 are all operated by the hydraulic supply by the pump unit 43. The trim-tilt equipment 40 has an oil path from the pump unit 43 to the oil inflow space 45*a* of the cylinder body 45 (not illustrated) and an oil path from the pump unit 43 to the oil inflow space 48*a* of the cylinder body 48 (not illustrated), and through these oil paths, the oil is sent to the tilt cylinder 44 and the trim cylinder 47.

A passage oil path 51 is formed on the front surface side of the casing 41 (see FIGS. 4 and 7). Further, in the lift equipment 30, a passage oil path 52 (see FIG. 3) leading to the oil inflow space 36*a* of the cylinder body 36 is formed rearward. In the state of the trim-tilt equipment 40 being assembled to the lift equipment 30, the oil can be supplied from the hydraulic supply system of the trim-tilt equipment 40 to the lift cylinder 33 through the passage oil path 51 and the passage oil path 52.

Figure 10:
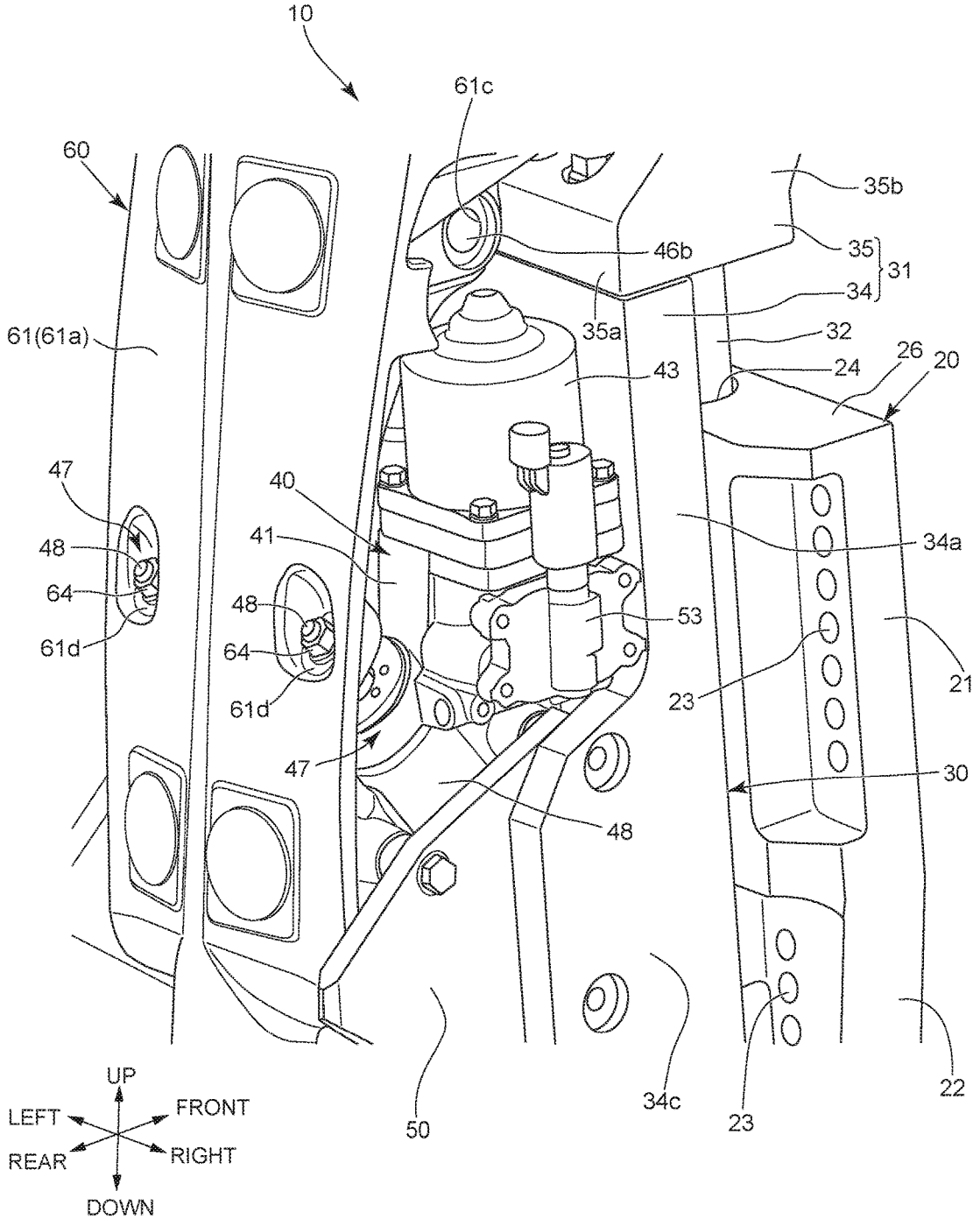
FIG. 10 is a perspective view illustrating a part of the outboard-motor mounting device.

As illustrated in FIG. 10, in the trim-tilt equipment 40, an electromagnetic valve 53 is provided on the side (right side) of the pump unit 43. By the operation of the electromagnetic valve 53, it is possible to alternatively switch the hydraulic supply destination from the hydraulic supply system of the trim-tilt equipment 40 to any of the lift cylinder 33 (oil inflow space 36*a*), the tilt cylinder 44 (oil inflow space 45*a*), and the trim cylinder 47 (oil inflow space 48*a*). That is, the electromagnetic valve 53 is oil path switcher for selecting and switching the hydraulic supply destination from the pump unit 43.

The hydraulic supply system of the trim-tilt equipment 40 is configured such that the oil does not move to the passage oil path 51 in a state where the tilt cylinder 44 (oil inflow space 45*a*) or the trim cylinder 47 (oil inflow space 48*a*) has been selected as the hydraulic supply destination.

Figure 8:
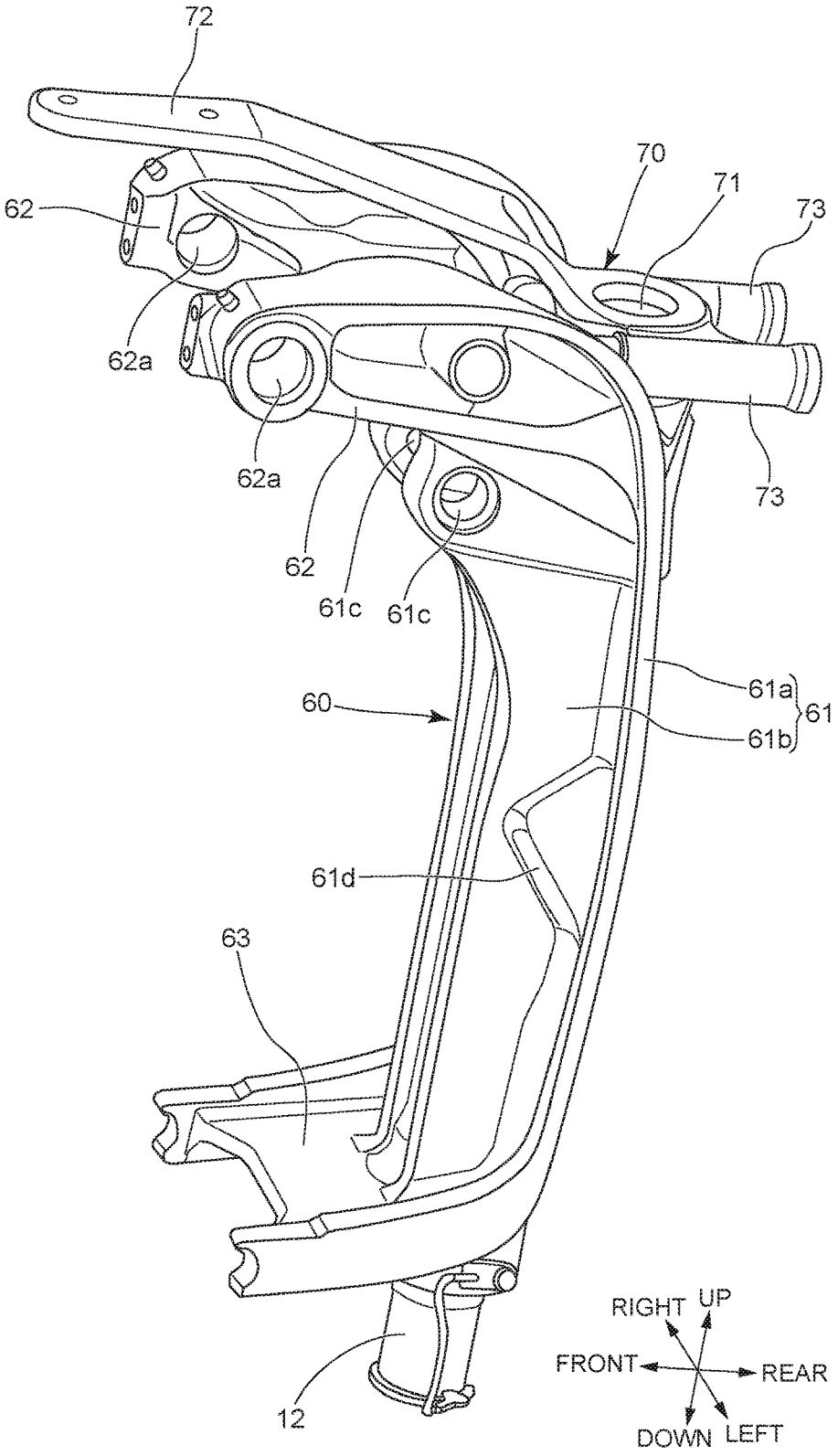
FIG. 8 is a perspective view of a swivel bracket and a steering bracket.

As illustrated in FIG. 8, the swivel bracket 60 has a vertical column 61 extending in the vertical direction, an upper projection 62 projecting forward from the upper end of the vertical column 61, and a lower projection 63 projecting forward from the lower end of the vertical column 61. As illustrated in FIGS. 4 and 8, the vertical column 61 has a plate-like portion 61*a* located closer to the rear (closer to the outboard motor body 1) in the front-rear direction, and a projecting portion 61*b* projecting forward from the center in the width direction of the plate-like portion 61*a*.

Figure 2:
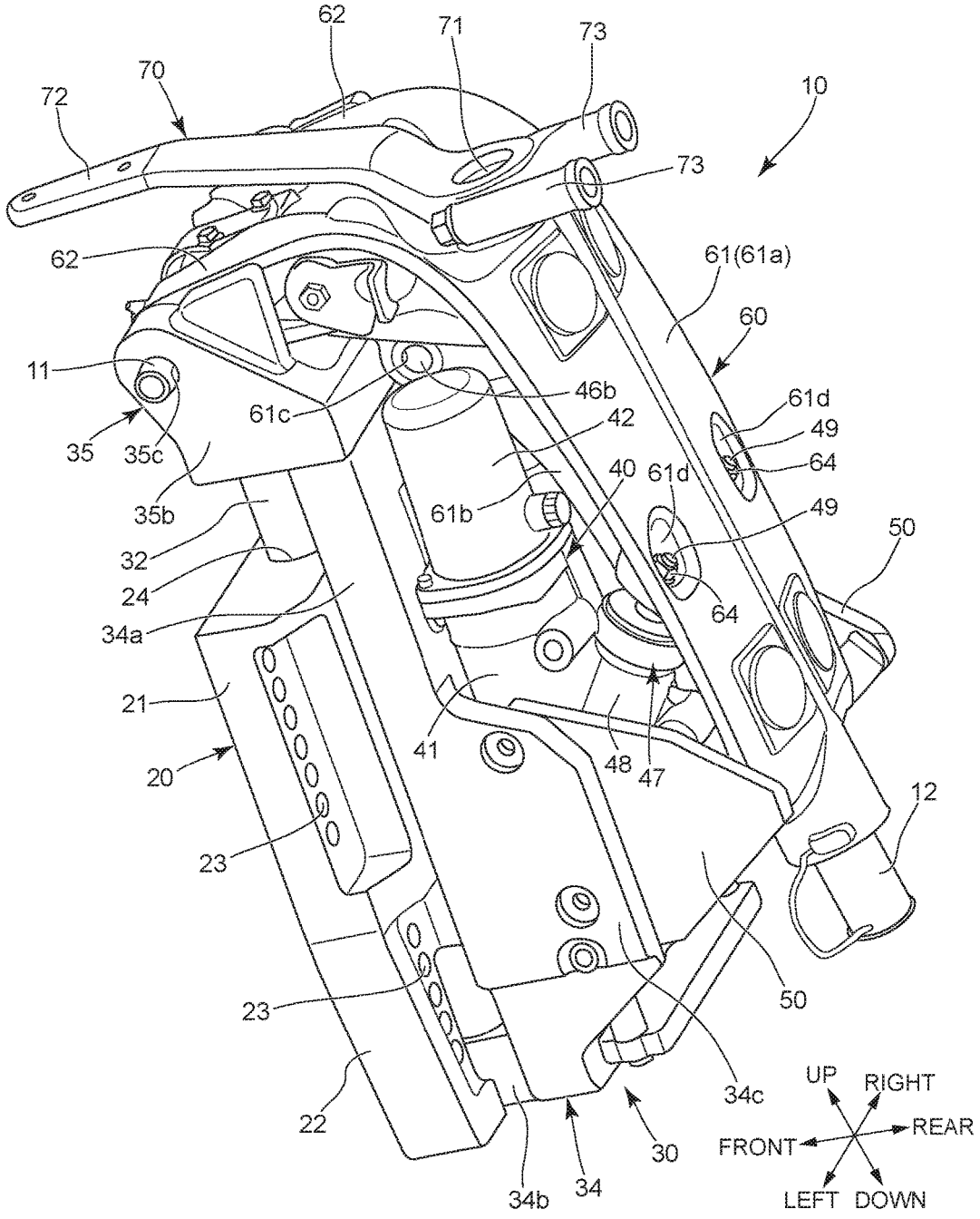
FIG. 2 is a perspective view illustrating the outboard-motor mounting device.

The tip of the upper projection 62 is bifurcated, and a pair of tilt shaft holes 62*a* is formed coaxially therethrough in the width direction. As illustrated in FIGS. 2 and 9, the tilt shaft 11 is inserted through the pair of axial support holes 35*c* in the lift equipment 30 and fixed. The upper projection 62 is located as held between the pair of rising walls 35*b* of the lift equipment 30, and the tilt shaft 11 is inserted through the pair of tilt shaft holes 62*a*. Accordingly, the swivel bracket 60 is swingably supported around the tilt shaft 11.

In the vertical column 61, a pair of right and left pin receiving holes 61*c*, located behind and below the pair of tilt shaft holes 62*a* (see FIG. 8), is formed. The tilt cylinder pin 46*b* provided at the upper end of the tilt cylinder 44 is inserted into the pair of pin receiving holes 61*c*. The tilt cylinder pin 46*b* is fitted so as to be rotatable relatively to the pin receiving hole 61*c*.

Further, in the vertical column 61, a pair of right and left trim cylinder connections 61*d* (see FIGS. 2, 8, and 10) is formed below the pin receiving hole 61*c*. Each trim cylinder connection 61*d* has a hole through the plate-like portion 61*a* of the vertical column 61. The tip of the piston rod 49 of the pair of trim cylinders 47 provided in the trim-tilt equipment 40 is inserted into the hole of each trim cylinder connection 61*d* and fixed with a nut 64.

As illustrated in FIGS. 3 and 4, in the swivel bracket 60, a steering shaft hole 65 is formed vertically through the projecting portion 61*b* of the vertical column 61. Near the upper end and the lower end of the steering shaft hole 65, cylindrical axial support sleeves 66 (FIG. 3) are provided.

As illustrated in FIGS. 2, 4, and 10, the vertical column 61 of the swivel bracket 60 is disposed so as to cover the rear of the trim-tilt equipment 40. More specifically, the plate-like portion 61*a* is located behind the pair of right and left trim cylinders 47, and the projecting portion 61*b* has entered between the pair of trim cylinders 47 in the width direction. Further, as illustrated in FIG. 3, the lower projection 63 of the swivel bracket 60 is located so as to cover the lower side of the trim-tilt equipment 40.

The steering shaft 12 is inserted into the steering shaft hole 65 of the swivel bracket 60. The steering shaft 12 is supported rotatably around the vertically directed axis with respect to the axial support sleeve 66 in the steering shaft hole 65. The steering bracket 70 is attached to the upper end of the steering shaft 12. The steering bracket 70 has an attachment hole 71 into which the steering shaft 12 is inserted. The steering shaft 12 is fixed to the attachment hole 71, and the steering bracket 70 swings integrally with the steering shaft 12.

The steering bracket 70 includes an arm 72 extended forward from the attachment hole 71. The arm 72 is connected to a steering handle or the like (not illustrated) on the hull side via a cable or the like (not illustrated). The steering bracket 70 also includes a connection 73 extended rearward from the attachment hole 71. The connection 73 is fixed to the outboard motor body 1 by bolting or the like. The lower end of the steering shaft 12 projects downward from the steering shaft hole 65 of the swivel bracket 60 (see FIGS. 3 and 8) and is fixed to the outboard motor body 1. The connection 73 and the steering shaft 12 are connected (fixed) with the outboard motor body 1 at suitable locations. For example, the connection 73 and the steering shaft 12 can be fixed to an engine mount supporting the engine 5 or the exterior member such as the drive housing 3.

The operation of the mounting device 10 configured as above will be described. First, the outboard motor body 1 swings back and forth around the tilt shaft 11 by the drive of the tilt cylinder 44 or trim cylinder 47 in the trim-tilt equipment 40. The swing of the outboard motor body 1 by the drive of the tilt cylinder 44 is referred to as a "tilt operation", and the swing of the outboard motor body 1 by the trim cylinder 47 is referred to as a "trim operation". The tilt operation is performed during the stoppage of the ship or when the hull is landed in a case where the outboard motor body 1 is greatly tilted to raise a portion including the propeller 9 above the water surface or in some other case. The trim operation is performed in a case where the inclination angle (trim angle) of the outboard motor body 1 in the vertical direction is adjusted to change the traveling posture while the propeller 9 is underwater or in some other case.

At the time of the tilt operation, the electromagnetic valve 53 is switched so that the oil is supplied into the tilt cylinder 44, and thereafter, the electric motor 42 drives the pump unit 43. The amount of projection of the piston rod 46 from the cylinder body 45 then changes due to the supplied hydraulic pressure. When the amount of projection of the piston rod 46 from the cylinder body 45 increases, the position of the tilt cylinder pin 46*b* becomes higher. The position where the tilt cylinder pin 46*b* is fitted to the pin receiving hole 61*c* is behind and below the position where the tilt shaft hole 62*a* is axially supported by the tilt shaft 11. Thus, when the position of the tilt cylinder pin 46*b* becomes higher and the swivel bracket 60 rotates around the tilt shaft 11 (counterclockwise rotation in FIG. 3), the outboard motor body 1 connected to the swivel bracket 60 via the steering bracket 70 and the steering shaft 12 performs a forward tilting operation to lower the engine 5 side and raise the propeller 9.

Conversely, when the tilt cylinder 44 is operated so as to reduce the amount of projection of the piston rod 46 from the cylinder body 45, the position of the tilt cylinder pin 46*b* becomes lower. Then, the outboard motor body 1 performs a rearward tilting operation to raise the engine 5 side and lower the propeller 9 by the rotation of the swivel bracket 60 around the tilt shaft 11 (clockwise rotation in FIG. 3).

At the time of the trim operation, the electromagnetic valve 53 is switched so that the oil is supplied to the right and left trim cylinders 47, and thereafter, the electric motor 42 drives the pump unit 43. Then, the amount of projection of each piston rod 49 from each cylinder body 48 changes due to the supplied hydraulic pressure. When the amount of projection of each piston rod 49 increases, the trim cylinder connection 61*d* is pushed up, and the swivel bracket 60 rotates around the tilt shaft 11 (counterclockwise rotation in FIG. 3). Thereby, the outboard motor body 1 performs a forward tilting operation to lower the engine 5 side and raise the propeller 9.

Conversely, when the trim cylinder 47 is operated so as to reduce the amount of projection of the piston rod 49 from each cylinder body 48, the trim cylinder connection 61*d* is lowered, and the swivel bracket 60 rotates around the tilt shaft 11 (clockwise rotation in FIG. 3). Thereby, the outboard motor body 1 performs a rearward tilting operation to raise the engine 5 side and lower the propeller 9.

The steering operation of the outboard motor body 1 to swing from side to side around the steering shaft 12 is performed by the input of an operating force to the steering bracket 70. When steering means such as the steering handle on the hull side is operated, a force for turning the arm 72 from side to side is transmitted. By this turning force, the steering bracket 70 and the steering shaft 12 rotate integrally, and the outboard motor body 1 having the fixation relationship with the steering bracket 70 and the steering shaft 12 swings from side to side. As a result, the traveling direction of the hull changes.

The mounting device 10 can further cause a lift operation for lifting and lowering the outboard motor body 1 with respect to the hull to be performed. The lift operation of the outboard motor body 1 is performed by the drive of the lift cylinder 33 in the lift equipment 30. As described above, the connection destination of the hydraulic supply system in the trim-tilt equipment 40 is switched to the lift cylinder 33 side by the electromagnetic valve 53, so that the hydraulic pressure can be supplied to the lift cylinder 33. When the pump unit 43 is driven by the electric motor 42 in this state, the amount of projection of the piston rod 37 from the cylinder body 36 changes due to the hydraulic pressure supplied through the passage oil path 51 and the passage oil path 52.

When the amount of projection of the piston rod 37 from the cylinder body 36 decreases, the position of the cylinder body 36 in the cylinder holder 25 changes upward, and the position of the lift bracket 31 becomes relatively high with respect to the clamp bracket 20 that is fixed to the transom 15 of the hull. Then, the position of the tilt shaft 11 supported by the axial support hole 35*c* near the upper end of the lift bracket 31 becomes higher, the respective positions of the swivel bracket 60, the trim-tilt equipment 40, the steering bracket 70, and the steering shaft 12 also become higher, and the outboard motor body 1 moves up.

When the amount of projection of the piston rod 37 from the cylinder body 36 increases, the position of the cylinder body 36 in the cylinder holder 25 changes downward, and the position of the lift bracket 31 becomes relatively low with respect to the clamp bracket 20 that is fixed to the transom 15 of the hull. Then, the position of the tilt shaft 11 supported by the axial support hole 35*c* near the upper end of the lift bracket 31 becomes lower, the respective positions of the swivel bracket 60, the trim-tilt equipment 40, the steering bracket 70, and the steering shaft 12 also become lower, and the outboard motor body 1 moves down.

As described above, in the mounting device 10 of the present embodiment, in addition to the tilt operation, the trim operation, and the steering operation, the lifting operation for the outboard motor body 1 with respect to the hull can be performed by use of the lift equipment 30. Unlike the positioning for the bolting of the clamp bracket 20 onto the transom 15, the lifting operation can be performed arbitrarily by the mounting device 10, with the mounting device 10 mounted on the outboard motor body 1. Therefore, the height of the outboard motor body 1 can be easily set at the optimum position in accordance with the state of the ship, which is extremely useful for the improvement in navigation performance and the protection of the outboard motor body 1. The mounting device 10 is small, lightweight, and excellent in strength and durability.

More specifically, in the mounting device 10, the lift equipment 30 is liftably supported on the clamp bracket 20, and the trim-tilt equipment 40 is disposed behind the lift equipment 30. As illustrated in FIG. 4, in the lift equipment 30, the lift cylinder 33 is disposed at the center in the width direction, and the pair of lift shafts 32 is disposed each to the right and left of the lift cylinder 33. In the trim-tilt equipment 40, the tilt cylinder 44 is disposed behind the lift cylinder 33, and a pair of trim cylinders 47 is disposed to the right and left of the tilt cylinder 44 (behind the pair of lift shafts 32). The electric motor 42 and the pump unit 43 are disposed separately to the left and right of the tilt cylinder 44 above the pair of trim cylinders 47. Further, the steering shaft 12 inserted into the steering shaft hole 65 of the swivel bracket 60 is disposed behind the tilt cylinder 44, and located between the pair of right and left trim cylinders 47 in the width direction. Therefore, a plurality of components constituting the mounting device 10 are disposed with favorable space efficiency while a gap between the components is minimized. Due to a small gap between each component, foreign matter such as driftwood and dust drifting on the water surface is less likely to be caught between each component.

As illustrated in FIG. 4, the lift bracket 31 of the lift equipment 30 has the rear holder 34*d* having the U-shaped structure where the pair of side flanges 34*c* is projected to the rear surface side of the base portion 34*a*, and the tilt cylinder 44 and the pair of trim cylinders 47 of the trim-tilt equipment 40 are located within the range in the width direction of the rear holder 34*d* of the lift bracket 31. Therefore, the trim-tilt equipment 40 is compactly fit in the width direction behind the lift equipment 30.

By the pair of side plates 50 being held between the pair of side flanges 34*c* of the lift bracket 31, the movement in the width direction of the trim-tilt equipment 40 is restricted. The side plate 50 has a dimension covering the majority of the casing 41 of the trim-tilt equipment 40 from the side, and the pair of side plates 50 and the pair of side flanges 34*c* protect the side of the trim-tilt equipment 40.

As illustrated in FIGS. 2, 3, 4, and 10, the vertical column 61 (especially, the plate-like portion 61*a*) of the swivel bracket 60 is disposed covering the rear of the trim-tilt equipment 40, and the upper projection 62 and the lower projection 63 of the swivel bracket 60 are located in the upper and lower sides of the trim-tilt equipment 40, respectively. Hence the rear and the upper and lower sides of the trim-tilt equipment 40 are each protected by being covered with the swivel bracket 60. The front of the trim-tilt equipment 40 is protected by being covered with the lift bracket 31 (especially, the base portion 34*a*) of the lift equipment 30.

The trim-tilt equipment 40 is a unit provided with many movable parts, such as the electric motor 42, the pump unit 43, the tilt cylinder 44, and the trim cylinder 47, and is high in price. Thus, by disposing the lift bracket 31 and the swivel bracket 60 so as to surround the trim-tilt equipment 40, it is possible to effectively protect the trim-tilt equipment 40 from the impact, foreign matter, and the like from the outside.

As illustrated in FIG. 4, the lift cylinder 33 enters into the cylinder holder 25 so that the length occupied by the clamp bracket 20 and the lift equipment 30 is reduced in the front-rear direction of the outboard motor. Further, the fitting of a part of the trim-tilt equipment 40 to the rear holder 34*d* of the lift bracket 31 has reduced the length occupied by the lift equipment 30 and the trim-tilt equipment 40 in the front-rear direction of the outboard motor. Moreover, the projecting portion 61*b* of the swivel bracket 60, having a steering shaft hole 65, enters between the pair of trim cylinders 47 so that the length occupied by the trim-tilt equipment 40 and the swivel bracket 60 is reduced in the front-rear direction of the outboard motor. With these configurations, while the mounting device 10 is provided with the lift equipment 30 and the trim-tilt equipment 40, the length in the front-rear direction from the transom 15 to the outboard motor body 1 can be reduced. In case that the distance from the hull to the outboard motor body 1 increases, a moment acting on a portion, where the outboard motor body 1 which is a heavy object is mounted onto the hull, also increases. Therefore, the mounting device 10 with the length from the transom 15 to the outboard motor body 1 reduced is excellent in terms of high strength and rigidity in addition to the size reduction in the front-rear direction.

Concerning the lifting guidance of the lift equipment 30, the clamp bracket 20 has an integral structure with the pair of shaft insertion holes 24 provided in the body portion 21. In the lift equipment 30, after the formation of the double supported structure where the upper and lower ends of each lift shaft 32 are fixed to the lift bracket 31 (the upper-end block 35*a* and the lower-end block 34*b*), the intermediate portion between the upper and lower ends of the lift shaft 32 is inserted into each shaft insertion hole 24. The lift shaft 32 inserted into each shaft insertion hole 24 moves axially, thereby lifting or lowering the lift equipment 30.

In this configuration, regardless of the lifting position of the lift equipment 30, the entire shaft insertion hole 24 constantly overlaps the lift shaft 32, and a wide range of the axial intermediate portion of the lift shaft 32 is covered with the clamp bracket 20. Therefore, with a simple structure having high support strength for the lift shaft 32, it is possible to realize a smooth lifting operation and stable postural maintenance of the outboard motor body 1. Further, since the range covered with the clamp bracket 20 in the axial direction of the lift shaft 32 is wide, the lift shaft 32 reduces the area in contact with seawater and lake water, and it is advantageous in dealing with electrolytic corrosion. Moreover, the pair of lift shafts 32 is not exposed to the side of the mounting device 10, but most of the side portion of the lift shaft 32 is protected by the body portion 21 and the leg 22 of the clamp bracket 20, so that foreign matter is less likely to be caught in the sliding portion of the lift shaft 32 and the shaft insertion hole 24.

In the mounting device 10, the passage oil path 51 and the passage oil path 52 are provided between the lift equipment 30 and the trim-tilt equipment 40, and the common pump unit 43 performs the hydraulic supply to the lift cylinder 33 of the lift equipment 30 and the hydraulic supply to the tilt cylinder 44 and the trim cylinder 47 of the trim-tilt equipment 40. It is thereby possible to share the drive of the lift equipment 30 and the drive of the trim-tilt equipment 40 and realize the cost reduction of the mounting device 10. In particular, since the pump unit 43 is a component with a high unit of price, the cost reduction effect exerted by the sharing of the pump unit 43 is high.

In the mounting device 10, the clamp bracket 20 is fixed to the hull side, and the other components are portions lifted and lowered along with the outboard motor body 1. Therefore, the mounting device 10 is a highly versatile device that is mountable onto various hulls without requiring structural changes on the hull side.

Note that the present invention is not limited to the above embodiment but can be subjected to various changes and then implemented. In the above embodiment, the sizes and shapes illustrated in the accompanying drawings are not limited thereto but can be changed as appropriate within a scope in which the effect of the present invention is exerted. The other elements can be changed as appropriate and implemented so long as not deviating from the scope of the object of the present invention.

For example, unlike the trim-tilt equipment 40 of the above embodiment, it is also possible to use trim-tilt equipment with a configuration where an electric motor and a pump unit are provided below a casing.

In the above embodiment, the electromagnetic valve 53 for switching the oil path has been disposed on the side of the pump unit 43 (see FIG. 10). Unlike this configuration, it is also possible to dispose the electromagnetic valve below or behind the trim-tilt equipment or in some other position. It is also possible to use oil path switcher other than the electromagnetic valve.

As described above, the outboard-motor mounting device of the present invention has the effect of being compact and excellent in strength and durability and is useful for outboard motors assumed to be mounted onto various types of ships.

REFERENCE SIGNS LIST

1 outboard motor body
2 engine cover
3 drive housing
4 lower housing
5 engine
6 drive shaft
7 propeller shaft
9 propeller
10 mounting device
11 tilt shaft
12 steering shaft
15 transom
20 clamp bracket
24 shaft insertion hole
25 cylinder holder
30 lift equipment

31 lift bracket
32 lift shaft
33 lift cylinder
34*c* side flange
34*d* rear holder
36 cylinder body
37 piston rod
40 tilt equipment
41 casing
42 electric motor
43 pump unit
44 tilt cylinder
45 cylinder body
46 piston rod
46*b* tilt cylinder pin
47 trim cylinder
48 cylinder body
49 piston rod
50 side plate (regulated portion)
51 passage oil path
52 passage oil path
53 electromagnetic valve (oil path switcher)
60 swivel bracket
61 vertical column
62 upper projection
63 lower projection
65 steering shaft hole
70 steering bracket

What is claimed is:

1. An outboard-motor mounting device comprising:
a clamp bracket attachable to a stern portion of a hull;
a swivel bracket disposed between the clamp bracket and an outboard motor body;
a trim-tilt equipment that swings the outboard motor body back and forth via the swivel bracket; and
a lift equipment that lifts and lowers the outboard motor body via the swivel bracket,
wherein:
the lift equipment has a lift cylinder for lifting and is liftably supported on the clamp bracket,
the trim-tilt equipment has a tilt cylinder and a trim cylinder and is disposed behind the lift equipment so that the tilt cylinder is positioned behind the lift cylinder and the trim cylinder is positioned on a side of the tilt cylinder,
the lift equipment has a lift bracket disposed behind the clamp bracket, and lifts and lowers the lift bracket with respect the clamp bracket by use of the lift cylinder,
the lift bracket has a rear holder opened rearward, and the tilt cylinder and the trim cylinder of the trim-tilt equipment are disposed within a range in a width direction of the rear holder,
the lift equipment has a lift shaft,
the clamp bracket has a shaft insertion hole into which an intermediate portion between upper and lower ends of the lift shaft is inserted, and
the shaft insertion hole and the lift shaft guide the lifting and lowering performed by the lift equipment.

2. The outboard-motor mounting device according to claim 1, wherein the trim-tilt equipment has a regulated portion that is fitted to the rear holder and is restricted in movement in the width direction with respect to the lift bracket.

3. The outboard-motor mounting device according to claim 1, wherein:
a pair of the lift shafts are provided at different positions in the width direction, and
the lift cylinder is disposed between the pair of lift shafts.

4. An outboard-motor mounting device comprising:
a clamp bracket attachable to a stern portion of a hull;
a swivel bracket disposed between the clamp bracket and an outboard motor body;
a trim-tilt equipment that swings the outboard motor body back and forth via the swivel bracket; and
a lift equipment that lifts and lowers the outboard motor body via the swivel bracket,
wherein:
the lift equipment has a lift cylinder for lifting and is liftably supported on the clamp bracket,
the trim-tilt equipment has a tilt cylinder and a trim cylinder and is disposed behind the lift equipment so that the tilt cylinder is positioned behind the lift cylinder and the trim cylinder is positioned on a side of the tilt cylinder,
the trim-tilt equipment has a pump unit for hydraulic supply and an electric motor that drives the pump unit, and
the electric motor and the pump unit are disposed on respective sides of the tilt cylinder.

5. The outboard-motor mounting device according to claim 4, further comprising:
an oil path switcher for selecting between the lift cylinder, the tilt cylinder, and the trim cylinder, and causing hydraulic pressure to be supplied from the pump unit,
wherein the oil path switcher is disposed on a side of the pump unit.

6. The outboard-motor mounting device according to claim 1, further comprising:
a steering shaft that is a center of side-to-side swings of the outboard motor body with respect to the swivel bracket,
wherein:
a pair of the trim cylinders are provided on respective sides of the tilt cylinder, and
the steering shaft is disposed behind the lift cylinder and between the pair of the trim cylinders in the width direction.

7. The outboard-motor mounting device according to claim 4, further comprising:
a steering shaft that is a center of side-to-side swings of the outboard motor body with respect to the swivel bracket,
wherein:
a pair of the trim cylinders are provided on respective sides of the tilt cylinder, and
the steering shaft is disposed behind the lift cylinder and between the pair of the trim cylinders in a width direction.

* * * * *